US009741287B2

(12) United States Patent
Na et al.

(10) Patent No.: US 9,741,287 B2
(45) Date of Patent: Aug. 22, 2017

(54) ORGANIC LIGHT EMITTING DISPLAY HAVING SHARED SCAN LINES

(71) Applicant: LG DISPLAY CO., LTD., Seoul (KR)

(72) Inventors: Sehwan Na, Paju-si (KR); Dohyung Kim, Paju-si (KR); Youngju Park, Seoul (KR)

(73) Assignee: LG Display Co., Ltd., Seoul (KR)

( * ) Notice: Subject to any disclaimer, the term of this patent is extended or adjusted under 35 U.S.C. 154(b) by 22 days.

(21) Appl. No.: 14/572,220

(22) Filed: Dec. 16, 2014

(65) Prior Publication Data

US 2015/0356920 A1 Dec. 10, 2015

(30) Foreign Application Priority Data

Jun. 10, 2014 (KR) ..... 10-2014-0070059

(51) Int. Cl.
*G09G 3/32* (2016.01)
*G09G 3/3233* (2016.01)

(52) U.S. Cl.
CPC ... *G09G 3/3233* (2013.01); *G09G 2300/0426* (2013.01); *G09G 2300/0814* (2013.01); *G09G 2300/0819* (2013.01); *G09G 2300/0852* (2013.01); *G09G 2300/0866* (2013.01); *G09G 2310/0262* (2013.01); *G09G 2310/08* (2013.01)

(58) Field of Classification Search
CPC ..... G09G 3/3258
USPC ..... 345/82, 76
See application file for complete search history.

(56) References Cited

U.S. PATENT DOCUMENTS

2006/0119554 A1* 6/2006 Kawae ..... G09G 3/2022 345/77
2007/0075938 A1 4/2007 Sung et al.
2009/0243977 A1* 10/2009 Chung ..... G09G 3/3233 345/76
2013/0119412 A1* 5/2013 Kasai et al. ..... H01L 27/3258 257/88
2014/0077176 A1 3/2014 Lee et al.
2015/0108482 A1* 4/2015 Kim ..... H01L 27/3276 257/71

FOREIGN PATENT DOCUMENTS

| | | | |
|---|---|---|---|
| CN | 1361510 | A | 7/2002 |
| CN | 1674073 | A | 9/2005 |
| CN | 101075407 | A | 11/2007 |
| CN | 101266757 | A | 9/2008 |
| CN | 100585673 | C | 1/2010 |
| CN | 101859536 | A | 10/2010 |
| CN | 103106872 | A | 5/2013 |
| TW | 201349475 | A | 12/2013 |
| TW | 201409446 | A | 3/2014 |

* cited by examiner

*Primary Examiner* — Long D Pham
(74) *Attorney, Agent, or Firm* — Birch, Stewart, Kolasch & Birch, LLP

(57) ABSTRACT

An organic light emitting display is discussed. The organic light emitting display includes a display panel including subpixels; and a driving part for supplying a driving signal to the display panel, wherein, in a first subpixel on an (N-1)th line and including a first transistor, and a second subpixel on an Nth line and including a second transistor, which are disposed adjacent to each other, gate electrodes of the first and second transistors are connected to one scan line.

18 Claims, 10 Drawing Sheets

ORGANIC LIGHT EMITTING DISPLAY HAVING SHARED SCAN LINES

CROSS-REFERENCE TO RELATED APPLICATION

This application claims priority to and the benefit of Korean Patent Application No. 10-2013-0070059 filed on Jun. 10, 2013, which is incorporated herein by reference for all purposes as if fully set forth herein.

BACKGROUND OF THE INVENTION

1. Field of the Invention

Embodiments of the invention relate to an organic light emitting display.

2. Description of the Related Art

An organic light emitting device adopted in an organic light emitting display is a self light emitting device which has a light emission layer formed between two electrodes. As for the organic light emitting device, electrons and holes are injected into a light emission layer from an electron injection electrode (cathode) and a hole injection electrode (anode), and excitons generated by coupling the injected electrons and holes to each other emit light while falling from an exciton state to the ground state.

Organic light emitting displays using an organic light emitting device are classified into a top emission type, a bottom emission type, a dual emission type, and the like, according to the emitting direction of light, and also are classified into a passive matrix type, an active matrix type, and the like, according to the driving manner.

In these organic light emitting displays, when a scan signal, a data signal, and power are supplied to a plurality of subpixels arranged in a matrix type, the selected subpixels emit light to thus display images.

As for the organic light emitting display, since the threshold voltage of the driving transistor included in the subpixel is shifted, the driving current is lowered over time, and thus the lifespan of the device is decreased. Therefore, the organic light emitting display adopts a compensation circuit for performing compensation of the threshold voltage shift characteristics of the driving transistor. However, in the instance where the compensation circuit is added into the subpixel of the organic light emitting display of a related art, the circuit needs to be implemented within a limited area, and thus the layout efficiency may deteriorate at the time of realizing high resolution. Due to this reason, these difficulties and disadvantages are required to be solved.

SUMMARY OF THE INVENTION

Therefore, embodiments of the invention have been made in view of the above problems, and it is an object of the embodiments of the invention to provide a display in which subpixels are optimized and use area is maximized, thereby realizing a high-resolution display.

An aspect of the invention is to provide an organic light emitting display, including: a display panel including subpixels; and a driving part for supplying a driving signal to the display panel, wherein, in a first subpixel on an (N-1)th line and including a first transistor, and a second subpixel on an Nth line and including a second transistor, which are disposed adjacent to each other, gate electrodes of the first and second transistors are connected to one scan line.

An aspect of the invention is to provide and organic light emitting display, including a display panel including a plurality of subpixels; and a driving part for supplying a driving signal to the display panel, wherein the plurality of subpixels include a first subpixel including a first transistor, and a second subpixel including a second transistor, the first and second subpixels being disposed adjacent to each other, and wherein gate electrodes of the first and second transistors are connected to one scan line.

BRIEF DESCRIPTION OF THE DRAWINGS

The accompany drawings, which are included to provide a further understanding of the invention and are incorporated on and constitute a part of this specification illustrate embodiments of the invention and together with the description serve to explain the principles of the invention. In the drawings.

DETAILED DESCRIPTION OF THE EMBODIMENTS

Reference will now be made to detail the embodiments of the invention, examples of which are illustrated in the accompanying drawings.

Hereinafter, specific embodiments of the invention will be described with reference to the accompanying drawings.

Figure 1:
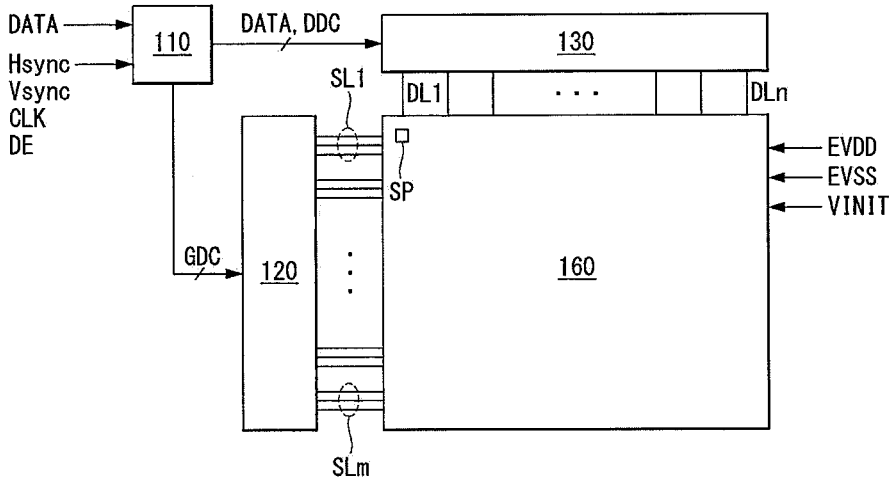
FIG. 1 is a diagram showing an organic light emitting display according to an embodiment of the invention.
Figure 2:
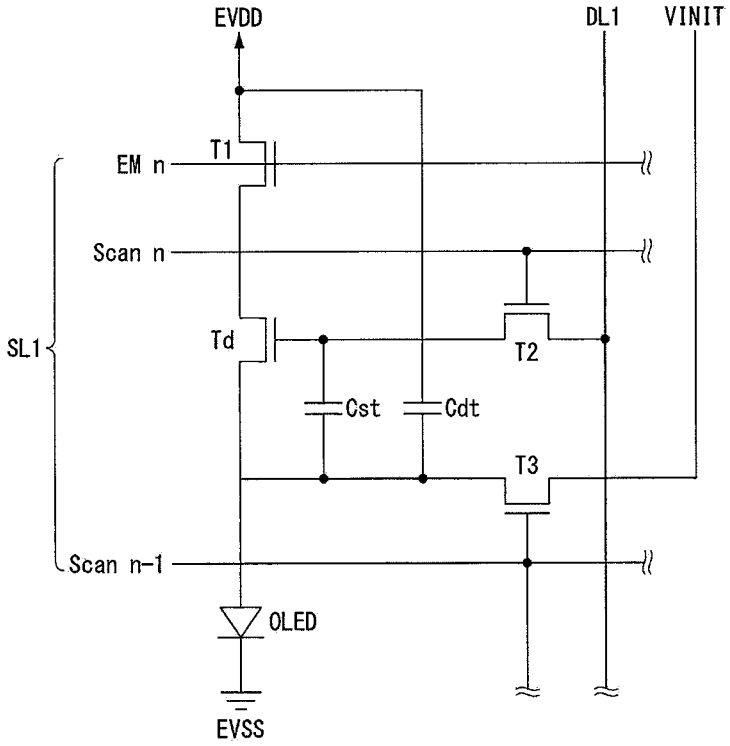
FIG. 2 is a circuit diagram of a subpixel according to an embodiment of the invention.
Figure 3:
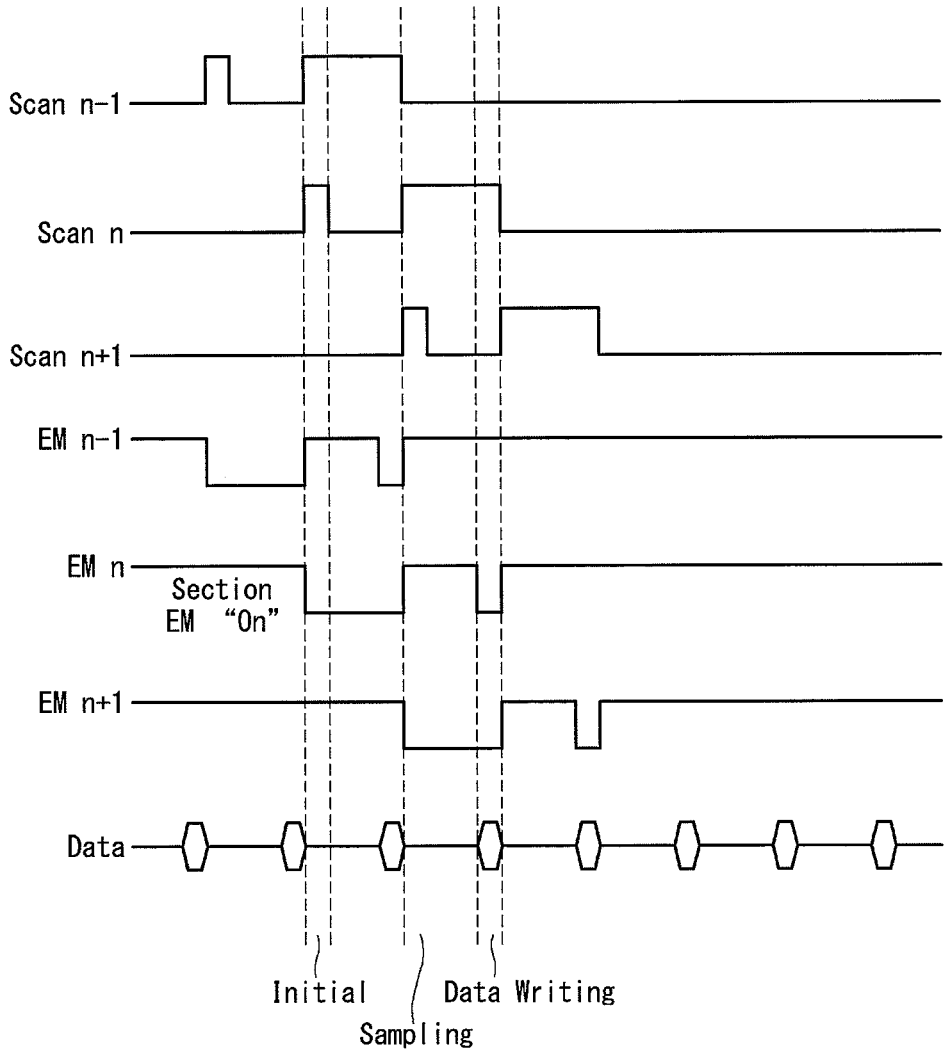
FIGS. 3 and 4 are driving waveform diagrams of an organic light emitting display having the subpixel shown in FIG. 2.
Figure 4:
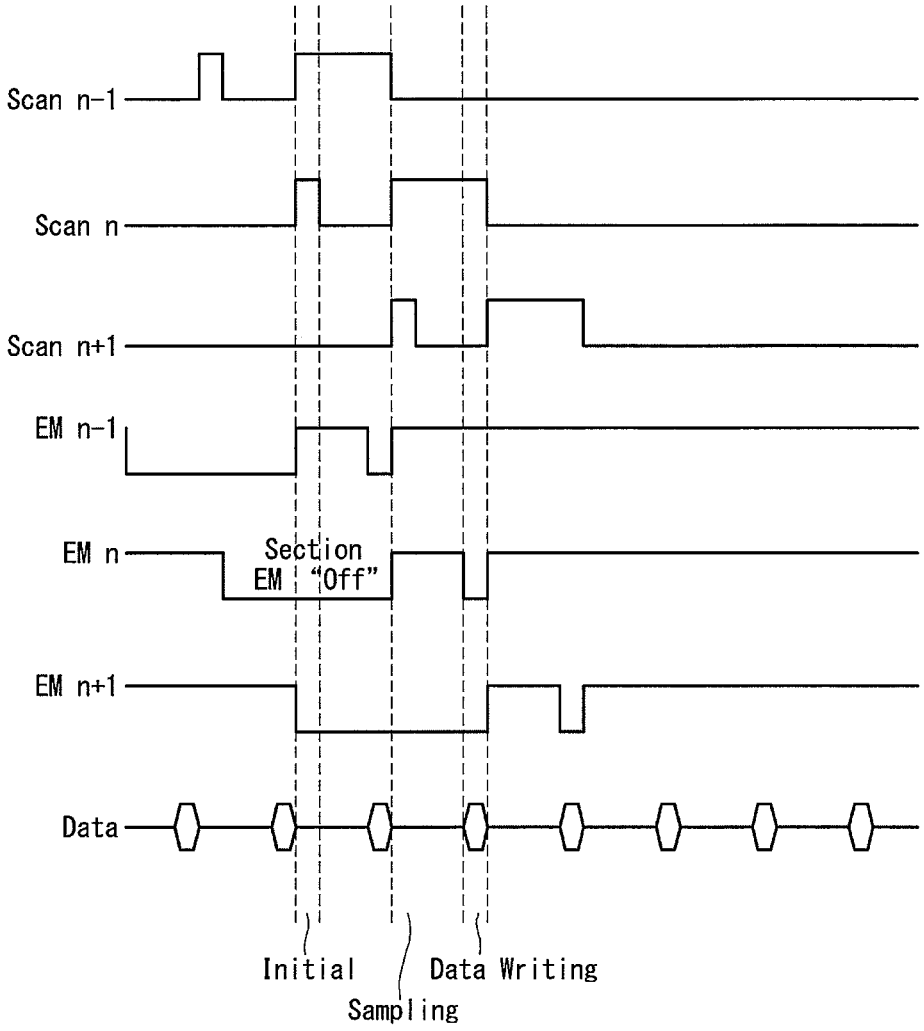

FIG. 1 is a diagram showing an organic light emitting display according to an embodiment of the invention; FIG. 2 is a circuit diagram of a subpixel according to an embodiment of the invention; and FIGS. 3 and 4 are driving waveform diagrams of an organic light emitting display having the subpixel shown in FIG. 2.

As shown in FIG. 1, an organic light emitting display according to an embodiment of the invention includes a timing controller 110, a data driving part 130, a scan driving part 120, and a display panel 160.

The timing controller 110 controls the operation timing of the data driving part 130 and the scan driving part 120 by using timing signals, such as a vertical synchronization signal Vsync, a horizontal synchronization signal Hsync, a data enable signal DE, and a clock signal CLK, which are supplied from the image processor 110. Since the timing controller 110 can determine a frame period by counting data enable signals of 1 horizontal period, the vertical synchronization signal Vsync and the horizontal synchronization signal Hsync supplied from the outside can be omitted. Here, the control signals generated from the timing controller 110 include a gate timing control signal GDC for controlling the operation timing of the scan driving part 120 and a data timing control signal DDC for controlling the operation timing of the data driving part 130.

The scan driving part 120 generates scan signals while shifting the level of a gate driving voltage, in response to the gate timing control signal GDC supplied form the timing controller 110. The scan driving part 120 supplies the scan signals through scan lines SL1-SLm connected to subpixels SP included in the display panel 160.

The data driving part 130 samples and latches a data signal DATA supplied from the timing controller 110, in response to the data timing control signal DDC supplied from the timing controller 110, and converts the data signal DATA into parallel format data. The data driving part 130 converts the data signal DATA from a digital signal to an analog signal in response to a gamma reference voltage. The data driving part 130 supplies the data signal DATA through data lines DL1-DLn connected to the subpixels SP included in the display panel 160.

The display panel 160 includes the subpixels SP that emit various colors of lights. The subpixels SP may include a red subpixel, a green subpixel, and a blue subpixel, and, in some instances, may include a white subpixel or the like. Meanwhile, in the display panel 160 including the white subpixel, the light emission layers of the respective subpixels SP may emit a white light instead of red, green, and blue lights. In this instance, the emitted white light is converted into a red, green, or blue light through a color conversion filter (e.g., RGB color filters).

The subpixels SP included in the display panel 160 is driven based on, together with the data signal DATA and the scan signals, a high voltage supplied through a first power line EVDD, a low voltage supplied through a second power line EVSS, and an initialization voltage supplied through the initialization line VINIT. The display panel 160 displays particular images based on the subpixels SP which emit light in response to driving signals supplied from the data driving part 130 and the scan driving part 120.

As shown in FIG. 2, the subpixel included in the display panel 160 is formed in a configuration of (or referred to as) 4T(Transistor)2C(Capacitor) (i.e., 4T2C) including first to third transistors T1-T3, an organic light emitting diode OLED, a driving transistor Td, and first and second capacitors Cst and Cdt.

Hereinafter, the connection between devices included in the subpixel and roles of the devices will be briefly described.

As for the first transistor T1, a gate electrode is connected to a first scan line EM n, a first electrode is connected to a first power line EVDD, and a second electrode is connected to a first electrode of a driving TFT Td. The first transistor T1 serves to control the light emission period of the subpixel.

As for the second transistor T2, a gate electrode is connected to a second scan line Scan n, a first electrode is connected to a first data line DL1, and a second electrode is connected to a gate electrode of the driving TFT Td. The second transistor T2 serves to control the data signal, which is supplied through the first data line DL1, to be stored in the first capacitor Cst.

As for the third transistor T3, a gate electrode is connected to a third scan line Scan n-1, a first electrode is connected to an initialization line VINIT, and a second electrode is connected to the second electrode of the driving transistor Td, the other end of the first capacitor Cst, and the other end of the second capacitor Cdt. The third transistor T3 serves to control the initialization voltage to be supplied to nodes to which the second electrode of the driving TFT Td, the other end of the first capacitor Cst, and the other electrode of the second capacitor Cdt are connected.

As for the driving transistor Td, a gate electrode is connected to the second electrode of the second transistor T2 and one end of the first capacitor Cst, a first electrode is connected to the second electrode of the first transistor T1, and a second electrode is connected to an anode electrode of the organic light emitting diode OLED, the second electrode of the third transistor T3, the other end of the first capacitor Cst, and the other end of the second capacitor Cdt. The driving transistor Td serves to supply a driving current to the organic light emitting diode OLED based on a data voltage stored in the first capacitor Cst.

As the first capacitor Cst, one end is connected to the gate electrode of the driving transistor Td, and the other end is connected to the second electrode of the driving transistor Td and the other end of the second capacitor Cdt. The first capacitor Cst serves to store the data voltage.

As for the second capacitor Cdt, one end is connected to the first power line EVDD, and the other end is connected to the second electrode of the driving transistor Td and the other end of the first capacitor Cst. The second capacitor Cdt serves to store a compensation voltage (or a boosting voltage).

As for the organic light emitting diode OLED, an anode electrode is connected to the second electrode of the driving transistor Td, and a cathode electrode is connected to the second power line EVSS. The organic light emitting diode OLED serves to emit light in response to the driving current supplied from the driving transistor Td.

The subpixel formed in a configuration of 4T2C includes the third transistor T3 as a compensation circuit, and thus is operated in response to the scan signals supplied through three scan lines EM n, Scan n, and Scan n-1. In addition, the scan line SL1 on a single line includes three scan lines EM n, Scan n, and Scan n-1.

As shown in FIG. 3, the above-described subpixel emits light after an initializing stage, a sampling stage, and a data writing stage, and specific descriptions thereof will be made.

—Initializing Stage—

When the third scan signal supplied through the third scan line Scan n-1 is at a logic high state, the third transistor T3 is turned on, and the initialization operation proceeds. When the third transistor T3 is turned on, an initialization voltage is supplied to the nodes to which the second electrode of the driving TFT Td, the other end of the first capacitor Cst, and the other electrode of the second capacitor Cdt are connected. Here, the third scan signal is maintained at a logic high state before the starting of the sampling stage, but is not limited thereto. In addition, the first scan signal supplied through the first scan line EM n may be at a logic low state, while the second signal supplied through the second scan line Scan n may be at a logic high state.

When the initialization operation proceeds, the nodes to which the second electrode of the driving transistor Td, the other end of the first capacitor Cst, and the other end of the second capacitor Cdt are connected are initialized at a predetermined voltage (e.g., a voltage or a negative voltage close to the ground level, etc.).

—Sampling Stage—

When the first scan signal supplied through the first scan line Em n is at a logic high state and the second signal supplied through the second scan line Scan n is at a logic high state, the first and second transistors T1 and T2 are turned on, and then the sampling operation proceeds. When the first and second transistors T1 and T2 are turned on, the data signal can be compensated through the sampling for compensating the threshold voltage Vth of the driving transistor Td. Here, the third scan signal may be maintained at a logic low state.

—Data Writing Stage—

While the second scan signal supplied through the second scan line Scan n is at a logic high state, when the first scan signal supplied through the first scan line Em n is at a logic low state, the first transistors T1 is turned off, and then the data writing operation proceeds. When the data writing operation proceeds, the data voltage with the compensated threshold voltage Vth of the driving transistor Td is stored in the first capacitor Cst. Here, the first and third scan signals may be maintained at a logic low state.

—Light Emitting Stage—

When the data writing operation is completed, and then the first scan signal is converted from the logic low state to the logic high state, the driving transistor Td is turned on. In addition, the driving transistor Td generates a driving current in response to the data voltage stored in the first capacitor Cst, and the organic light emitting diode OLED emits light in response to the driving current. Here, the second and third scan signals may be maintained at a logic low state.

Meanwhile, according to the above-described driving waveforms, as the first scan signal is maintained at a logic high state during the procedure before the initializing stage proceeds (see section EM "On" in FIG. 3), the current path is formed between the initialization line and the first power line. In this instance, a current excessively flows through the corresponding current path, and thus an error may occur in the data driving part or the initializing voltage may vary, causing problems in the display quality.

In this instance, as shown in FIG. 4, the current path formed between the initialization line and the first power line can be removed by changing the section at which the logic low state of the first scan signal is started.

Figure 5:
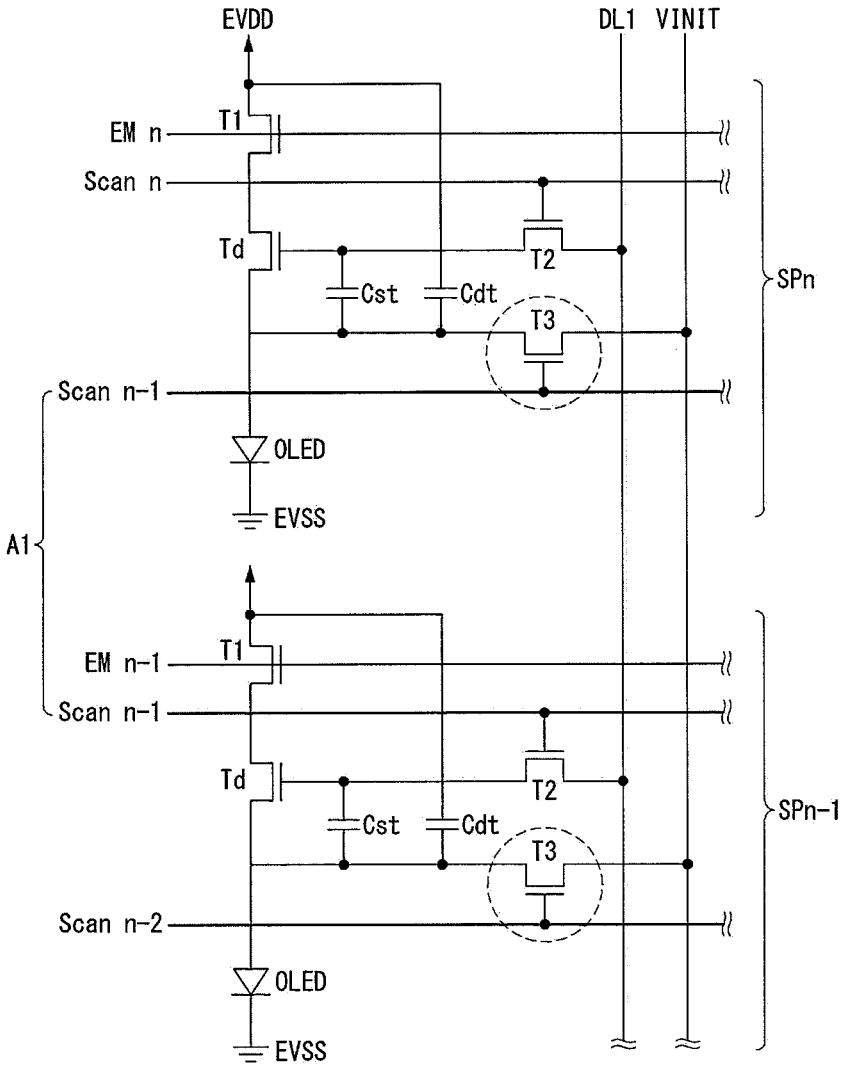
FIG. 5 is a circuit diagram of a 4T2C subpixel according to a comparative example.
Figure 6:
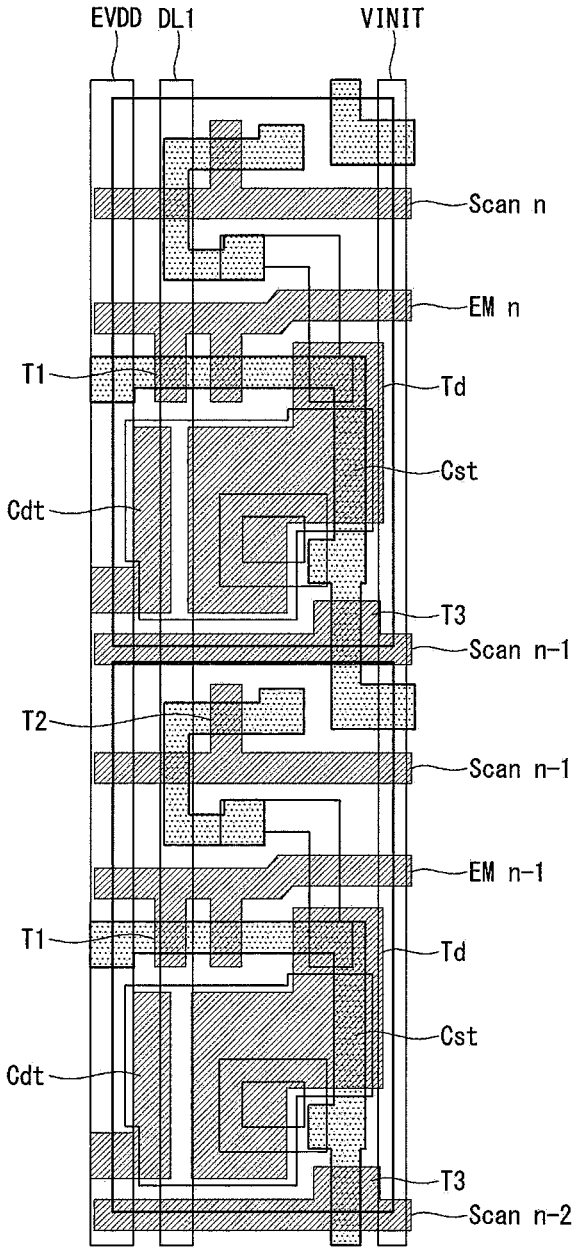
FIG. 6 is a plane view of a subpixel designed based on the circuit structure shown in FIG. 5.
Figure 7:
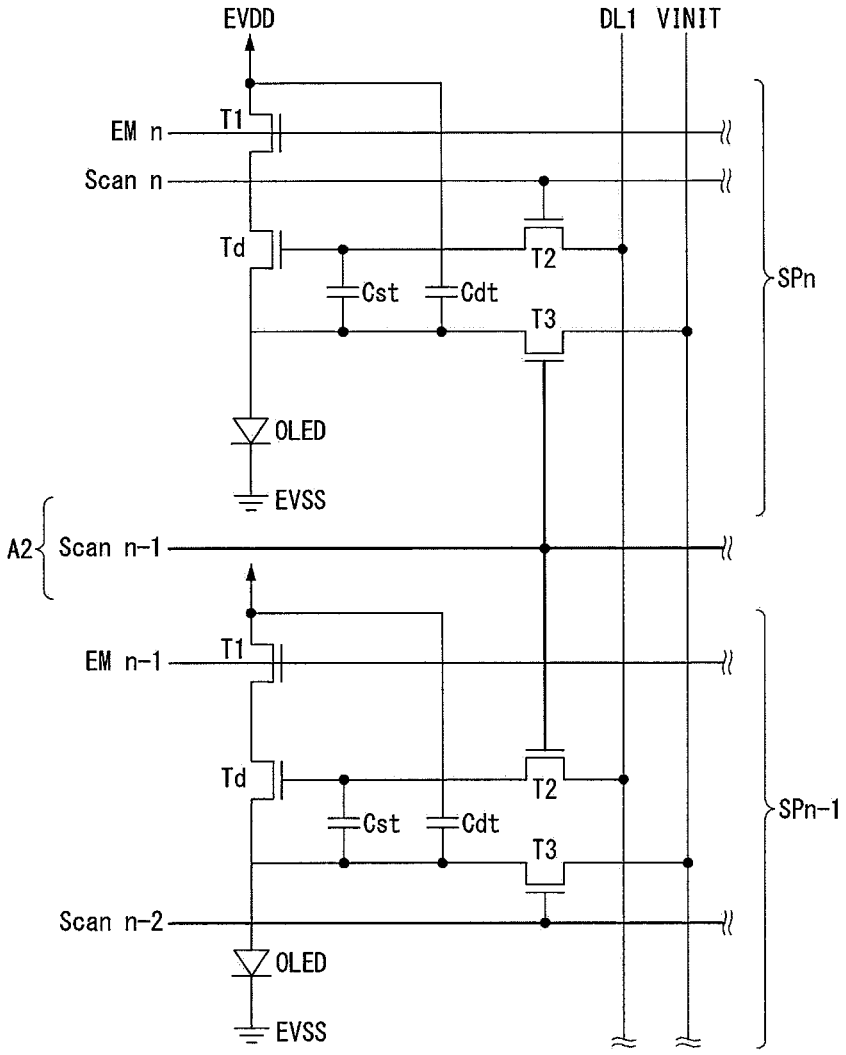
FIG. 7 is a circuit diagram of a 4T2C subpixel according to an example of an embodiment the invention.
Figure 8:
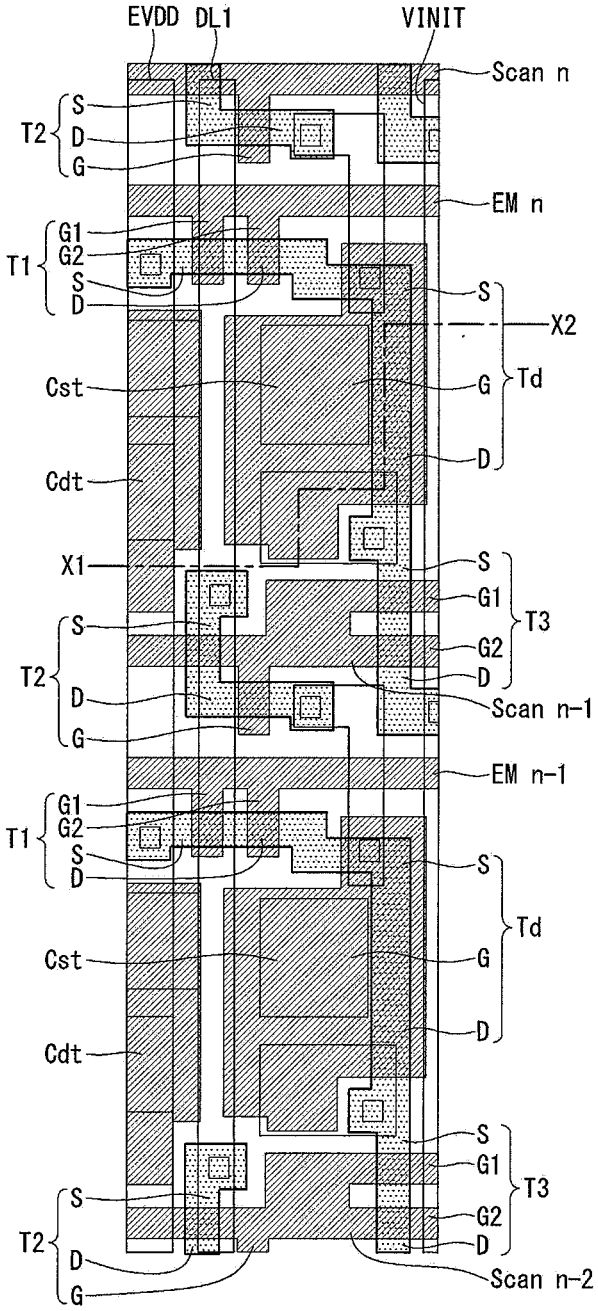
FIG. 8 is a plane view of a subpixel designed based on the circuit structure shown in FIG. 7.
Figure 9:
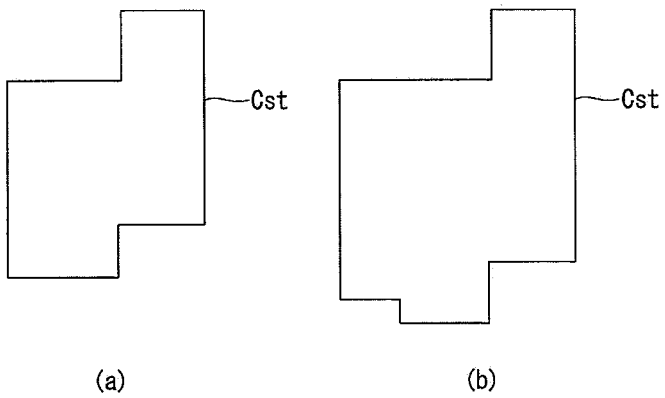
FIG. 9 is a view for comparing the areas of first capacitors of the 4T2C subpixels according to the comparative example and according to the example of an embodiment of the invention.
Figure 10:
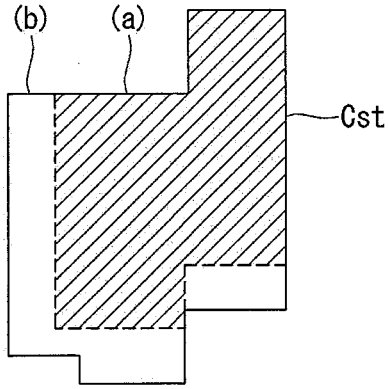
FIG. 10 is a diagram showing overlapping areas of the first capacitors of the 4T2C subpixels according to the comparative example and the embodiment shown in FIG. 9.
Figure 11:
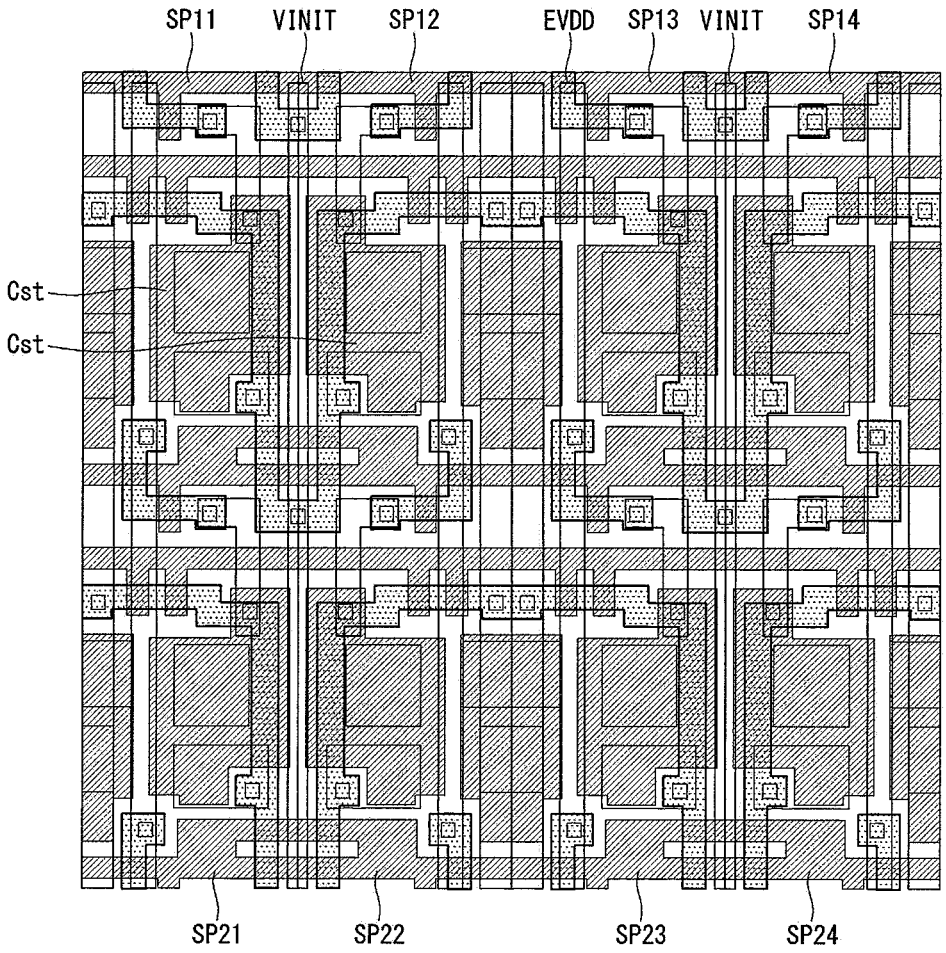
FIG. 11 is a diagram showing a part of a display panel composed of the 4T2C subpixel according to the example of an embodiment of the invention.
Figure 12:
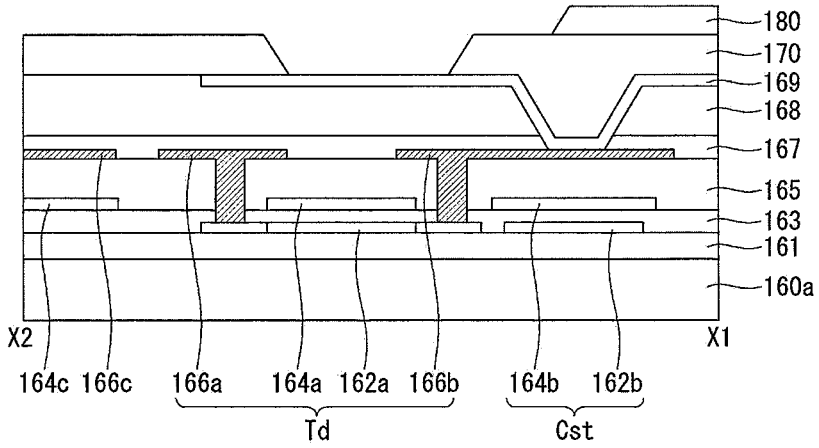
FIG. 12 is a first example view of a cross section along line X1-X2 of FIG. 8.
Figure 13:
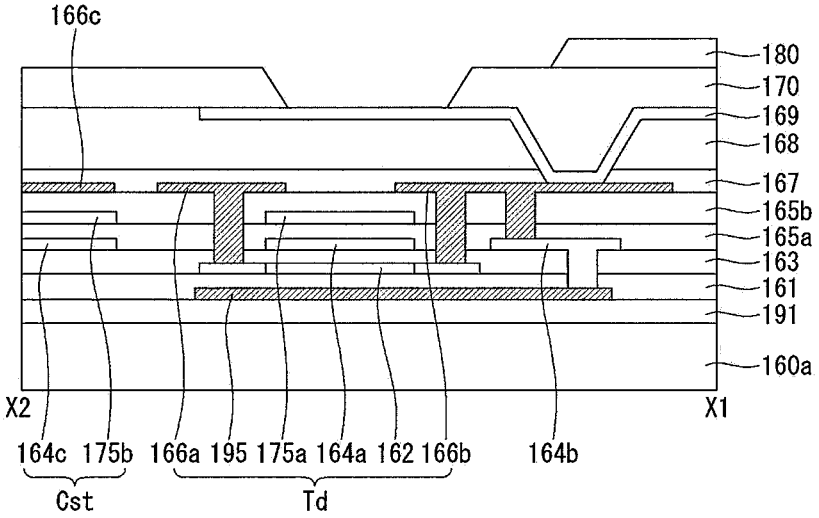
FIG. 13 is a second example view of a cross section along line X1-X2 of FIG. 8.

FIG. 5 is a circuit diagram of a 4T2C subpixel according to a comparative example; FIG. 6 is a plane view of a subpixel designed based on the circuit structure shown in FIG. 5; FIG. 7 is a circuit diagram of a 4T2C subpixel according to an example of the invention; FIG. 8 is a plane view of a subpixel designed based on the circuit structure shown in FIG. 7; FIG. 9 is a view for comparing the areas of first capacitors of the 4T2C subpixels according to the comparative example and according to the example of an embodiment of the invention; FIGS. 9 and 10 are view for showing the overlapping of the areas of the first capacitors of the 4T2C subpixels according to the comparative example and according to the example of an embodiment of the invention shown in FIG. 9; FIG. 11 is a diagram showing a part of a display panel composed of the 4T2C subpixel according to the example; FIG. 12 is a first example view of a cross section along line X1-X2 of FIG. 8; and FIG. 13 is a second example view of a cross section along line X1-X2 of FIG. 8.

As shown in FIG. 5, a subpixel according to a comparative example is formed in a configuration of 4T2C including first to third transistors T1-T3, an organic light emitting diode OLED, a driving transistor Td, and first and second capacitors Cst and Cdt.

The 4T2C subpixels according to the comparative example are shown by two subpixels including a subpixel SPn-1 on an (N-1)th line and a subpixel SPn on an Nth line which are positioned above and below.

A subpixel SPn-1 on the (N-1)th line and a subpixel SPn on the Nth line adopt the same third scan line Scan n-1 as shown in sign "A1". When viewed from the subpixel Spn On the Nth line, the third scan line Scan n-1 is a second scan line for the subpixel Spn-1 on the (N-1)th line positioned at the front.

However, as can be seen from the plane view of FIG. 6, the third scan line Scan n-1 included in both the subpixel SPn on the Nth line and the subpixel Spn-1 on the (N-1)th line is shown as two separate lines in a display area of the display panel.

Since the subpixel SPn on the Nth line and the subpixel SPn-1 on the (N-1)th line share the third scan line Scan n-1, the same signal is supplied to the subpixels. However, the third scan line Scan n-1 needs to be divided into two lines as shown in the comparative example due to the design margin or structural characteristics of the display panel.

Therefore, the optimization of design is needed in order to design the subpixels added with the compensation circuit as described above. At the time of optimization the design, a capacitor having a predetermined capacitance needs to be secured in order to maintain basic display quality. Further, in the instance where the reduction in the driving current is required, the size of the driving transistor (Driving TFT length) needs to be larger.

However, the design area is gradually increased with the increase in the number of pixels per inch (PPI), and thus there is a limit in decreasing the size of a circuit (transistor, capacitor, etc.) necessary for actual operation. Therefore, in order to secure the basic performance of the circuit and decrease the design area, a method of commonly using multiple signal lines needs to be employed, unlike the comparative example shown in FIG. 5.

Due to this reason, the invention is to seek a scheme to optimize the circuit and structure of the above-described 4T2C subpixel and maximize the use area thereof, in order to realize a high-resolution display panel.

As shown in FIG. 7, the subpixel according to an example of the invention is formed in a configuration of 4T2C including first to third transistors T1-T3, an organic light emitting diode OLED, a driving transistor Td, and first and second capacitors Cst and Cdt.

The 4T2C subpixel according to the example of the invention is shown by two subpixels including a subpixel SPn-1 on the (N-1)th line and a subpixel SPn on the Nth line, which are positioned above and below.

A subpixel SPn-1 on an (N-1)th line and a subpixel SPn on the Nth line share a third scan line Scan n-1 as one body, as shown in sign "A2". That is, since the subpixel SPn on the Nth line and the subpixel SPn-1 on the (N-1)th line share the third scan line Scan n-1, a single third scan line as an integrated body is formed in the display area of the display panel in the example of the invention while the two divided third scan lines are formed in the comparative example. Further, a space prepared by integrating the two divided third scan lines Scan n-1 is used to realize the optimization of design.

As shown in FIG. 8, the first power line EVDD, the first data line DL1, and the initialization line VINIT are arranged in a first direction (vertical direction) such that the lines are connected to the subpixel SPn-1 on the (N-1)th line and the subpixel SPn on the Nth line, which are positioned above and below.

The first power line EVDD and the first data line DL1 are adjacent to each other, but spaced apart from each other. The initialization line VINIT is spaced apart from the first data line DL1 such that the space therebetween is wider than the space between the first power line EVDD and the first data line DL1.

When viewed from a second direction, the first power line EVDD, the first data line DL1, and the initialization line VINIT are arranged in this order.

The first scan line Em n, the second scan line Scan n, and the third scan line Scan n-1 are disposed in the second direction (horizontal direction) crossing the first direction (vertical direction). The scan line Em n and the second line Scan n are adjacent to each other, but spaced apart from each other. The third scan line Scan n-1 is spaced apart from the first scan line Em n such that the space therebetween is wider than the space between the first scan line Em n and the second scan line Scan n.

When viewed from the first direction (from a top of the page), the second scan line Scan n, the first scan line Em n, and the third scan line Scan n-1 are arranged in that order.

Meanwhile, in the description with reference to FIG. 2, source and drain electrodes, except a gate electrode, of the first to third transistor T1-T3 and the driving transistor Td are designated by first and second electrodes. Unlike this, in the description with reference to FIG. 8, source and drain electrodes, except a gate electrode G, of the first to third transistor T1-T3 and the driving transistor Td are designated by a source electrode S and a drain electrode D instead of the first and second electrodes. The reason is to prevent the restrictive interpretation since the designations of the source and drain electrodes, except the gate electrode, of the transistors T1-T3 and Td, may vary depending on the connection direction and the supply direction of current (or voltage).

Hereinafter, the positions of respective devices will be described in view of the subpixel SPn on the Nth line.

The second transistor T2 is formed above the subpixel since the gate electrode of the second transistor T2 is connected to the second scan line Scan n. The first transistor T1 is formed in the center of the subpixel, which is between the second transistor T2 and the first and second capacitors Cst and Cdt since the gate electrode of the first transistor T1 is connected to the first scan line Em n. The driving transistor Td is formed in the center of the subpixel, which is between the second transistor T2 and the third transistor T3 since the gate electrode of the driving transistor Td is connected to the first capacitor Cst and the second electrode of the second transistor T2. The third transistor T3 is formed below the subpixel since the gate electrode of the third transistor T3 is connected to the third scan line Scan n-1 together with the second transistor T2 of the subpixel SPn-1 on the (N-1)th line.

According to the example of the invention, the gate electrode of the second transistor T2 of the subpixel SPn-1 on the (N-1)th line and the gate electrode of the third transistor T3 of the subpixel SPn on the Nth line share the third scan line Scan n-1. In other words, the gate electrode of the second transistor T2 of the subpixel SPn-1 on the (N-1)th line and the gate electrode of the third transistor T3 of the subpixel SPn on the Nth line are formed together with the third scan line Scan n-1 by the same process. However, the gate electrode of the second transistor T2 of the subpixel SPn-1 on the (N-1)th line and the gate electrode of the third transistor T3 of the subpixel SPn on the Nth line are formed to have different shapes in a structure (a pattern on the plane).

According to the example of the invention, due to the above-described structure, each scan line is deleted every line in the display area of the display panel, thereby securing the margin of design to optimize the display panel.

In the example of the invention, the gate electrode of a particular transistor is formed as dual gates by using the secured margin of design. The term "dual gates" refers to two gate electrodes G1 and G2 formed in the same layer, and a transistor with double gates mitigates or removes vulnerable factors due to hot carrier stress (stress causing a deterioration in DC performance) or driving stress (positive/negative bias stress), thereby improving reliability of the device, when compared with a transistor with a single gate.

For example, since the margin of design cannot be secured in the comparative example as shown in FIG. 6, the gate electrode of the third transistor T3 used for initialization needs to be formed as a single gate. Whereas, since the margin of design can be secured in the example of the invention as shown in FIG. 8, the gate electrode of the third transistor T3 used for initialization can be formed as dual gates.

Specifically, the first gate electrode G1 of dual gate electrodes G1 and G2 of the third transistor T3 protrudes from the third scan line Scan n-1 in a first direction and disposed in a second direction. Here, the first electrode G1 of the dual gate electrodes G1 and G2 of the third transistor T3 protrudes in a direction in which the initialization line VINIT is positioned. Whereas, the second gate electrode G2 of the dual gate electrodes G1 and G2 of the third transistor T3 is disposed in the second direction in the same manner as the third scan line Scan n-1.

In embodiments of the invention, the scan line Scan n-1 extends in a first direction. Meanwhile, the gate electrode D of the second transistor T2 extends from the scan line Scan n-1 in a second direction that intersects the first direction, and the gate electrodes G1 and G2 of the third transistor T3 extends in the second direction.

As another example, since the margin of design cannot be secured in the comparative example as shown in FIG. 6, the gate electrode of the first transistor T1 used at the time of controlling the light emission period of the subpixel needs to be formed as a single gate. Whereas, since the margin of design can be secured in the example embodiment as shown in FIG. 8, the gate electrode of the first transistor T1 used at the time of controlling the light emission period of the subpixel can be formed as dual gates.

Specifically, the first and second gate electrodes G1 and G2 of the dual gate electrodes G1 and G2 of the first transistor T1 protrudes from the first scan line Em n in the first direction and disposed. The first and second gate electrodes G1 and G2 of the first transistor T1 protrudes in a direction in which the first and second capacitors Cst and Cdt are positioned.

As still another example, since the margin of design cannot be secured in the comparative example as shown in FIG. 6, the gate electrodes of the first and third transistors T1 and T3 need to be formed as a single gate. Whereas, since the margin of design can be secured in the example of the invention as shown in FIG. 8, the gate electrodes of the first and third transistors T1 and T3 can be formed as dual gates.

As still another example, since the margin of design cannot be secured in the comparative example as shown in FIG. 6, one side of the first scan line Em n is formed to be bent. Whereas, since the margin of design can be secured in the example of the invention as shown in FIG. 8, the scan line can be formed in a straight shape. That is, in the example of the invention, the scan line positioned in the display area of the display panel may be formed in a straight shape.

When the scan line is formed in a straight shape, the area of a particular capacitor can be enlarged by using the secured margin of design. The area of the capacitor is a structural index capable of increasing or reducing the charging capacitance of the capacitor. As one example, when the first scan line Em n is formed in a straight shape and the area of the first capacitor Cst is increased, the charging capacitance of the data voltage can be increased. As another example, when the first scan line Em n is formed in a straight shape and the area of the second capacitor Cdt is increased, the charging capacitance of the compensation voltage (or a boosting voltage) can be increased.

As shown in FIGS. 9 and 10, the margin of design cannot be secured in the comparative example (a) of FIG. 9, but the margin of design can be secured in the example of an embodiment of the invention (b) of FIG. 9, and thus the area of the first capacitor Cst can be increased, thereby decreasing problems such as flicker, and improving the display quality.

As shown in FIG. 11, in the example of the invention, two subpixels adjacent to each other in the left-and-right direction are formed to be bilaterally symmetrical to each other.

For example, the $11^{th}$ subpixel SP11 and the $12^{th}$ subpixels SP12 are formed to be bilaterally symmetrical to each other based on the initialization line VINIT. As another example, the $12^{th}$ subpixel SP12 and the $13^{th}$ subpixels SP13 are formed to be bilaterally symmetrical to each other based on the first power line EVDD. As such, the $13^{th}$ and $14^{th}$, $21^{st}$ and $22^{nd}$, $23^{rd}$ and $24^{th}$ subpixels SP13 and SP14, SP21 and SP22, SP23 and SP24 are also formed to be bilaterally symmetrical to each other based on the initialization line VINIT or the first power line EVDD.

When two subpixels adjacent to each other in the left-and-right direction are formed to be symmetrical to each other based on the signal line or power line going between the two subpixels as described above, the subpixels can be uniformly formed, thereby securing the margin of design more easily.

Hereinafter, a cross-sectional structure of the subpixel will be described.

—First Example of Cross-Sectional Structure of Subpixel—

As shown in FIG. 12, a buffer layer 161 is formed on a lower substrate 160*a*. The lower substrate 160*a* is formed of a glass or a resin, such as polyimide (PI), polyethylene terephthalate (PET), polyester sulfone (PES), polycarbonate (PC), polyethylene naphthalate (PEN), or polyurethane (PU). When the resin is selected for the lower substrate 160*a*, the lower substrate 160*a* has flexibility. The buffer layer 161 is formed to protect transistors formed in subsequent processes from impurity, such as an alkali ion flowing out from the lower substrate 160*a*. The buffer layer 161 may be formed of silicon oxide (SiOx) or silicon nitride (SiNx). The buffer layer 161 may be formed in a single layer type or a multi-layer type or, in some instances, may be omitted.

An active layer 162*a* of a driving transistor Td and a lower electrode 162*b* of a first capacitor Cst are formed on the lower substrate 160*a* or the buffer layer 161. The active layer 162*a* is formed of one selected from amorphous silicon, polysilicon, low-temperature polysilicon, oxide, and organic matter. The lower electrode 162*b* is an electrode of the first capacitor Cst.

A first insulating film 163 is formed on the active layer 162*a* and the lower electrode 162*b*. The first insulating film 163 may be formed of a silicon oxide film (SiOx), silicon nitride film (SiNx), or a double layer thereof.

First to third gate metal layers 164*a*, 164*b*, and 164*c* are formed on the first gate insulating film 163. The first to third gate metal layers 164*a*, 164*b*, and 164*c* may be formed of one selected from molybdenum (Mo), aluminum (Al), chromium (Cr), gold (Au), titanium (Ti), nickel (Ni), and copper (Cu), or an alloy thereof, and may be formed in a single layer type or a multi-layer type. The first gate metal layer 164*a* becomes a gate electrode of the driving transistor Td. The second gate metal layer 164*b* becomes an upper electrode of the first capacitor Cst. The third gate metal layer 164*c* becomes a scan line.

A second insulating film 165 is formed on the first to third gate metal layers 164*a*, 164*b*, and 164*c*. The second insulating film 165 may be formed of a silicon oxide film (SiOx), silicon nitride film (SiNx), or a double layer thereof.

First to third source-drain metal layers 166*a*, 166*b*, and 166*c* are formed on the second gate insulating film 165. The first to third source-drain metal layers 166*a*, 166*b*, and 166*c* may be formed of one selected from molybdenum (Mo), aluminum (Al), chromium (Cr), gold (Au), titanium (Ti), nickel (Ni), and copper (Cu), or an alloy thereof, and may be formed in a single layer type or a multi-layer type. The first and second source-drain metal layers 166*a* and 166*b* become a source electrode and a drain electrode of the driving transistor Td, and thus contacted with a source region and a drain region of the active layer 162*a* formed below. The third source-drain metal layer 166*c* becomes a data line.

Through the above-described process, a lower structure including an initialization line, first and second power lines, the scan line, the data line, the first to third transistors, an organic light emitting diode, the driving transistor, and the first and second capacitors are formed on the lower substrate 160*a*.

A third insulating film 167 is formed on the first to third source-drain metal layers 166*a*, 166*b*, and 166*c*. The third insulating film 167 is used as a protective film covering the lower structure including the transistors. The third insulating film 167 may be formed of a silicon oxide film (SiOx), silicon nitride film (SiNx), or a double layer thereof.

A planarization film 168 is formed on the third insulating film 167. The planarization film 168 planarizes an upper surface of the third insulating film 167. The planarization film 168 may be formed of organic matter, such as polyimide, a benzocyclobutene-based resin, acrylate, or photoacrylate.

A lower electrode 169 is formed on the planarization film 168. The lower electrode 169 is connected to the source or drain electrode of the driving transistor. The lower electrode 169 may be selected as an anode electrode or a cathode electrode of the organic light emitting diode. When the lower electrode 169 is selected as the anode electrode, the lower electrode 169 may be a transparent oxide electrode made of indium tin oxide (ITO), indium zinc oxide (IZO), or the like. In addition, the lower electrode 169 may be formed in a single electrode or a multi-layer electrode including a transparent electrode and a reflective electrode made of silver (Ag) or like, or further including other low resistive metal, but is not limited thereto.

A bank layer 170 is formed on the lower electrode 169. The bank layer 170 is a layer which exposes the lower electrode 169 so as to define an opening region (or a light emission region) of the subpixel. The bank layer 170 may be formed of organic matter, such as polyimide, a benzocyclobutene-based resin, acrylate, or photoacrylate.

A spacer 180 is formed on the bank layer 170. The spacer 180 is formed in a non-opening region except the opening region defined by the bank layer 170. The spacer 180 performs various roles, such as preventing a problem due to the contact between a mask and the bank layer 170 during the manufacturing process, or preventing the damage of the structure due to an impact to an upper substrate at the time of sealing between the lower substrate 160*a* and the upper substrate. However, the spacer 180 may be omitted or may be removed after the process is completed, depending on the process manner.

A light emission layer and an upper electrode of the organic light emitting diode are further formed on the lower electrode 169. The light emission layer may include at least one of a hole injection layer (HIL), a hole transport layer (HTL), an electron block layer (EBL), a hole block layer (HBL), an electron transport layer (ETL), and an electron injection layer (EIL), but is not limited thereto. In addition, the upper electrode is selected as a cathode electrode or an anode electrode. The upper electrode may be a single layer electrode made of silver (Ag), aluminum (Al), magnesium (Mg), lithium (Li), calcium (Ca), lithium fluoride (LiF), ITO, or IZO, a multilayer electrode made thereof, or a mixture electrode made of a mixture thereof, but is not limited thereto.

—Second Example of Cross-Sectional Structure of Sub-pixel—

As shown in FIG. 13, a first buffer layer 191 is formed on a lower substrate 160*a*. The lower substrate 160*a* is formed of a glass or a resin, such as polyimide (PI), polyethylene terephthalate (PET), polyester sulfone (PES), polycarbonate (PC), polyethylene naphthalate (PEN), or polyurethane (PU). When the resin is selected for the lower substrate 160*a*, the lower substrate 160*a* has flexibility. The first buffer layer 191 serves to planarize a surface of the lower substrate 160*a*.

A shield metal layer 195 is formed on the first buffer layer 191. The shield metal layer 195 serves to block the incidence of external light in order to prevent the leakage of current of transistors formed on the lower substrate 160*a*. The shield metal layer 195 may be formed of a low-reflective material, and may be formed as a single layer or multiple layers having or consisting of different kinds of materials. The shield metal layer 195 is formed to correspond to an active layer of a particular transistor formed on the lower substrate 160*a* or correspond to the entire surface of the lower substrate 160*a*. Here, a region in which the shield metal layer 195 is formed may be extended to an inside of a display area defined on the lower substrate 160*a* or an outside of the display area, that is, a non-display area.

A second buffer layer 161 is formed on the shield metal layer 195. The second buffer layer 161 is formed to protect transistors formed in subsequent processes. The second buffer layer 161 may be formed of silicon oxide (SiOx), silicon nitride (SiNx), or the like. The buffer layer 161 may be formed in a single layer type or a multiple-layer type. However, in the instance where the shield metal layer 195 is omitted, the second buffer layer 161 may be also omitted.

An active layer 162 of a driving transistor Td is formed on the second buffer layer 161. The active layer 162 is formed of one selected from amorphous silicon, polysilicon, low-temperature polysilicon, an oxide, and an organic matter.

A first insulating film 163 is formed on the shield metal layer 162. The first insulating film 163 may be formed of a silicon oxide film (SiOx), silicon nitride film (SiNx), or a double layer thereof.

First to third gate metal layers 164*a*, 164*b*, and 164*c* are formed on the first gate insulating film 163. The first to third gate metal layers 164*a*, 164*b*, and 164*c* may be formed of one selected from molybdenum (Mo), aluminum (Al), chromium (Cr), gold (Au), titanium (Ti), nickel (Ni), and copper (Cu), or an alloy thereof, and may be formed as a single layer or multiple layers. The first gate metal layer 164*a* becomes a lower gate electrode of the driving transistor Td. The second gate metal layer 14*b* becomes a connection electrode connected with the shield metal layer 195. The third gate metal layer 164*c* becomes a lower electrode of the first capacitor Cst.

A second insulating film 165*a* is formed on the first to third gate metal layers 164*a*, 164*b*, and 164*c*. A (2-1)th insulating film 165*a* may be formed of a silicon oxide film (SiOx), silicon nitride film (SiNx), a double layer thereof.

First and second metal layers 175*a* and 175*b* are formed on the (2-1)th insulating film 165*a*. The first and second metal layers 175*a* and 175*b* may be formed of one selected from molybdenum (Mo), aluminum (Al), chromium (Cr), gold (Au), titanium (Ti), nickel (Ni), and copper (Cu), or an alloy thereof, and may be formed as a single layer or multiple layers. The first metal layer 175*a* becomes an upper gate electrode of the driving transistor (that is, the driving transistor has a double gate electrode structure in which two gate electrodes are formed above and below). The second gate metal layer 175*b* becomes an upper electrode of the first capacitor Cst.

A (2-2)th insulating film 165*b* is formed on the first and second metal layers 175*a* and 175*b*. The (2-2)th insulating film 165 may be formed of a silicon oxide film (SiOx), silicon nitride film (SiNx), or a double layer thereof.

First to third source-drain metal layers 166*a*, 166*b*, and 166*c* are formed on the (2-2)th insulating film 165. The first to third source-drain metal layers 166*a*, 166*b*, and 166*c* may be formed of one selected from molybdenum (Mo), aluminum (Al), chromium (Cr), gold (Au), titanium (Ti), nickel (Ni), and copper (Cu), or an alloy thereof, and may be formed in a single layer type or a multi-layer type. The first and second source-drain metal layers 166*a* and 166*b* become a source electrode and a drain electrode of the driving transistor Td, and thus contacted with a source region and a drain region of the active layer 162*a* formed below. The second source-drain metal layer 166*b* is connected with the shield metal layer 195 through the second metal layer 164*b*. The third source-drain metal layer 166*c* becomes a data line.

Through the above-described process, a lower structure including an initialization line, first and second power lines, the scan line, the data line, the first to third transistors, an organic light emitting diode, the driving transistor, and the first and second capacitors are formed on the lower substrate 160*a*.

A third insulating film 167 is formed on the first to third source-drain metal layers 166*a*, 166*b*, and 166*c*. The third insulating film 167 is used as a protective film covering the lower structure including the transistors. The third insulating film 167 may be formed of a silicon oxide film (SiOx), silicon nitride film (SiNx), or a double layer thereof.

A planarization film 168 is formed on the third insulating film 167. The planarization film 168 planarizes an upper surface of the third insulating film 167. The planarization film 168 may be formed of organic matter, such as polyimide, a benzocyclobutene-based resin, acrylate, or photoacrylate.

A lower electrode 169 is formed on the planarization film 168. The lower electrode 169 is connected to the source or drain electrode of the driving transistor Td. The lower electrode 169 may be selected as an anode electrode or a cathode electrode of the organic light emitting diode. When the lower electrode 169 is selected as the anode electrode, the lower electrode 169 may be a transparent oxide electrode made of indium tin oxide (ITO) or indium zinc oxide (IZO). In addition, the lower electrode 169 may be formed as a single electrode, a reflective electrode made of silver (Ag) or like together with a transparent electrode, or a multilayer electrode further including other low resistive metal, but is not limited thereto.

A bank layer 170 is formed on the lower electrode 169. The bank layer 170 is a layer which exposes the lower electrode 169 so as to define an opening region (or a light emission region) of the subpixel. The bank layer 170 may be formed of organic matter, such as polyimide, a benzocyclobutene-based resin, acrylate, or photoacrylate.

A spacer 180 is formed on the bank layer 170. The spacer 180 is formed in a non-opening region except the opening region defined by the bank layer 170. The spacer 180 performs various roles, such as preventing a problem due to the contact between a mask and the bank layer 170 during the manufacturing process, or preventing the damage of the structure due to an impact to an upper substrate at the time of sealing between the lower substrate 160*a* and the upper substrate. However, the spacer 180 may be omitted or may be removed after the process is completed, depending on the process manner.

A light emission layer and an upper electrode of the organic light emitting diode are further formed on the lower electrode 169. The light emission layer may include at least one of a hole injection layer (HIL), a hole transport layer (HTL), an electron block layer (EBL), a hole block layer (HBL), an electron transport layer (ETL), and an electron injection layer (EIL), but is not limited thereto. In addition, the upper electrode is selected as a cathode electrode or an anode electrode. The upper electrode may be a single layer electrode made of silver (Ag), aluminum (Al), magnesium (Mg), lithium (Li), calcium (Ca), lithium fluoride (LiF), ITO, or IZO, a multilayer electrode made thereof, or a mixture electrode made of a mixture thereof, but is not limited thereto.

As described above, the invention can provide an organic light emitting display in which the circuit and structure of the subpixel is optimized and the use area is maximized, thereby realizing a high-resolution display panel. Further, the invention can provide an organic light emitting display in which the charging capacitance of the capacitor is increased through the optimization of design, thereby improving the display quality. Further, the invention can provide an organic light emitting display in which vulnerable factors due to driving stress (positive/negative bias stress) are mitigated or removed through the structure with optimized design, thereby improving reliability of the device.

What is claimed is:

1. An organic light emitting display, comprising:

a display panel including first and second subpixels disposed adjacent to each other on (N-1)th and Nth lines, respectively, where N is an integer;

a driving part for supplying a driving signal to the display panel, wherein the first subpixel includes a first driving transistor, a first organic light emitting diode (OLED), a first transistor, and the second subpixel includes a second driving transistor, a second OLED, and a second transistor, wherein the first transistor includes a gate electrode directly connected to an (N-1)th scan line, a source electrode directly connected a data line, and a drain electrode directly connected to a gate electrode of the first driving transistor, and wherein the second transistor includes a gate electrode directly connected to the gate electrode of the first transistor, a drain electrode directly connected to an anode of the second OLED, and a source electrode directly connected to an initialization voltage line to provide an initialization voltage to the anode of the second OLED when the second transistor is turned on.

2. The organic light emitting display of claim 1, wherein the first and second transistors include:

a T2 transistor for performing a switching operation to supply a data signal to the first subpixel on the (N-1)the line; and a T3 transistor for performing a switching operation to supply the initialization voltage to the second subpixel on the Nth line.

3. The organic light emitting display of claim 2, wherein the T2 and T3 transistors share one scan line, and have different number of gate electrodes.

4. The organic light emitting display of claim 2, wherein the T2 transistor has a single gate electrode, and wherein the T3 transistor has dual gate electrodes disposed in the same layer.

5. The organic light emitting display of claim 4, wherein a first gate electrode of the dual gate electrodes of the T3 transistor protrudes from the one scan line in a first direction, and is disposed in a second direction, and wherein a second gate electrode of the dual gate electrodes of the T3 transistor is disposed in the second direction as the one scan line.

6. The organic light emitting display of claim 2, wherein the T2 and T3 transistors have dual gate electrodes of which two gate electrodes are disposed in the same layer.

7. The organic light emitting display of claim 1, wherein each of the subpixel on the (N-1)th line and the subpixel on the Nth line further includes a first scan line for transmitting a scan signal controlling a light emission period of the second OLED, and wherein the first scan line is formed in a straight form in a horizontal direction in a display area of the display panel.

8. The organic light emitting display of claim 1, wherein the subpixels adjacent to each other are bilaterally symmetrical to each other in the display area of the display panel.

9. An organic light emitting display, comprising:

a display panel including a plurality of subpixels, each subpixel including a plurality of switching transistors, an organic light emitting diode (OLED) and a driving transistor, and the plurality of subpixels including first and second subpixels disposed adjacent to each other on (N-1)th and Nth lines, respectively, where N is an integer; and a driving part for supplying a driving signal to the display panel, wherein the first subpixel includes a first driving transistor, a first organic light emitting diode (OLED), and a first switching transistor having a gate electrode directly connected to an (N-1)th scan line, a drain electrode directly connected to a gate electrode of the first driving transistor, and a source electrode directly connected a data line, wherein the second subpixel includes a second driving transistor, a second OLED, and a second switching transistor having a gate electrode directly connected to the gate electrode of the first transistor, a drain electrode directly connected to an anode of the second OLED, and a source electrode directly connected to an initialization voltage line to provide an initialization voltage to the anode of the second OLED when the second switching transistor is turned on, and wherein gate electrodes of the first and second switching transistors are connected to one scan line.

10. The organic light emitting display of claim 9, wherein the first switching transistor includes one gate electrode and the second switching transistor includes two gate electrodes, wherein the one scan line extends in a first direction, wherein the one gate electrode of the first switching transistor extends from the one scan line in a second direction that intersects the first direction, and wherein the two gate electrodes of the second switching transistor extends in the second direction.

11. The organic light emitting display of claim 10, wherein the first subpixel relates to the (N-1)th line and the second subpixel relates to the Nth line, where N is an integer, wherein the gate electrode of the first subpixel is a T2 transistor for performing a switching operation to supply a data signal to the first subpixel on the (N-1)th line, and wherein the gate electrode of the second subpixel is a T3 transistor for performing a switching operation to supply the initialization voltage to the second subpixel on the Nth line.

12. The organic light emitting display of claim 11, wherein each of the first subpixel on the (N-1)th line and the second subpixel on the Nth line further includes a first scan line for transmitting a scan signal controlling a light emission period of the second OLED, and wherein the first scan line is formed in a straight form in a display area of the display panel.

13. The organic light emitting display of claim 11, wherein the T2 and T3 transistors share one scan line, and have different number of gate electrodes.

14. The organic light emitting display of claim 11, wherein the T2 transistor has a single gate electrode, and the T3 transistor has dual gate electrodes disposed in the same layer.

15. The organic light emitting display of claim 14, wherein a first gate electrode of the dual gate electrodes of the T3 transistor protrudes from the one scan line in a first direction, and is disposed in a second direction, and wherein a second gate electrode of the dual gate electrodes of the T3 transistor is disposed in the second direction as the one scan line.

16. The organic light emitting display of claim 11, wherein the T2 and T3 transistors have dual gate electrodes of which two gate electrodes are disposed in the same layer.

17. The organic light emitting display of claim 9, wherein each of the subpixel on the (N-1)th line and the subpixel on the Nth line further includes a first scan line for transmitting a scan signal controlling a light emission period of the second OLED, and wherein the first scan line is formed in a straight form in a horizontal direction in a display area of the display panel.

18. The organic light emitting display of claim 9, wherein the subpixels adjacent to each other are bilaterally symmetrical to each other in the display area of the display panel.

* * * * *